US008152411B2

(12) United States Patent
Ottesen et al.

(10) Patent No.: US 8,152,411 B2
(45) Date of Patent: Apr. 10, 2012

(54) GUIDE ARRANGEMENT

(75) Inventors: Torfinn Ottesen, Orkanger (NO); Jan Arne Häll, Sarpsborg (NO)

(73) Assignee: Nexans, Paris (FR)

( * ) Notice: Subject to any disclaimer, the term of this patent is extended or adjusted under 35 U.S.C. 154(b) by 284 days.

(21) Appl. No.: 12/498,489

(22) Filed: Jul. 7, 2009

(65) Prior Publication Data

US 2010/0028086 A1 Feb. 4, 2010

(30) Foreign Application Priority Data

Aug. 1, 2008 (NO) ..... 20083370

(51) Int. Cl.
*F16L 1/12* (2006.01)

(52) U.S. Cl. ..... 405/172; 405/158; 405/171; 405/184.4; 405/224

(58) Field of Classification Search ..... 405/158, 405/168.1, 171, 172, 184.4, 224; 441/3–5
See application file for complete search history.

(56) References Cited

U.S. PATENT DOCUMENTS 4,933,917 A * 6/1990 Bruneval ..... 367/130
6,481,930 B2 * 11/2002 Forrest ..... 405/184
7,044,817 B2 * 5/2006 Bech ..... 441/5
2007/0059104 A1 * 3/2007 Clausen et al. ..... 405/171
2007/0081862 A1 * 4/2007 Wolbers et al. ..... 405/169
2009/0232605 A1 * 9/2009 Breivik ..... 405/203
2011/0052324 A1 * 3/2011 Bruschi et al. ..... 405/166

FOREIGN PATENT DOCUMENTS

GB 2311503 10/1997

* cited by examiner

*Primary Examiner* — John Kreck
*Assistant Examiner* — Sean Andrish
(74) *Attorney, Agent, or Firm* — Sofer & Haroun, LLP

(57) ABSTRACT

Guide arrangement for marine risers, in particular for offshore oil and gas operations. The guide arrangement has at least one guide structure (21, 22) for a length of riser, a frame assembly (10, 10A-D) for supporting said guide structure, anchor means (11, 12) at the seabed, tether means (13, 14) connecting said frame assembly to said anchor means, and a buoyancy element (1) for keeping said guide structure (21, 22) at a desired level in the sea during operation. The guide structure (21, 22) is pivotably supported by said frame assembly (10, 10A-D) with a pivot axis (21P, 22P) being substantially horizontal.

10 Claims, 2 Drawing Sheets

FIG. 1
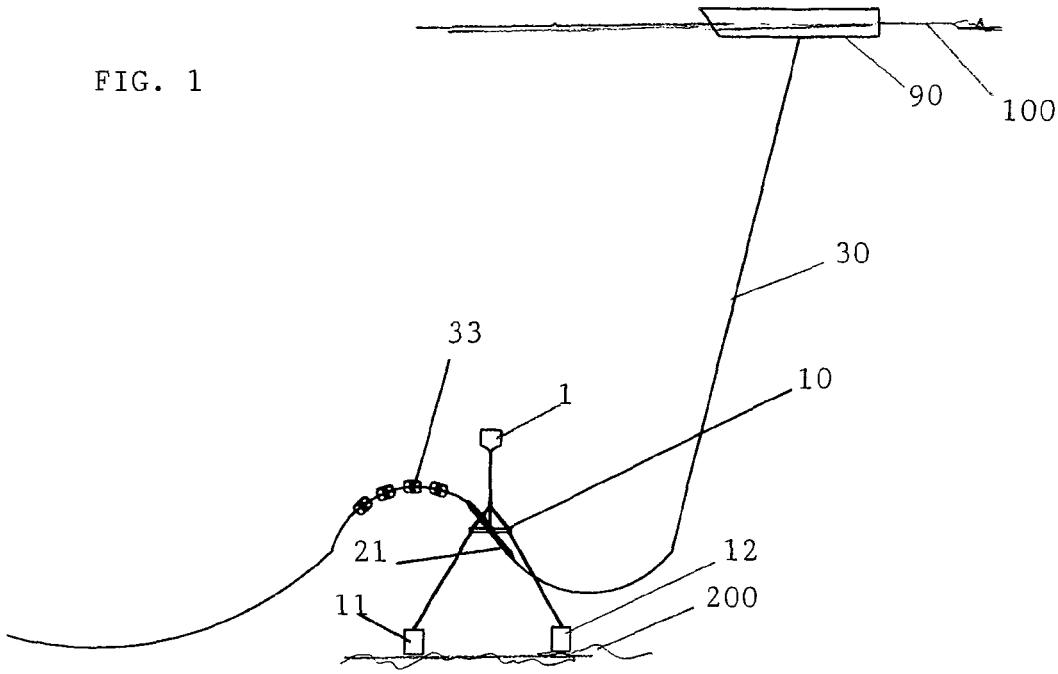
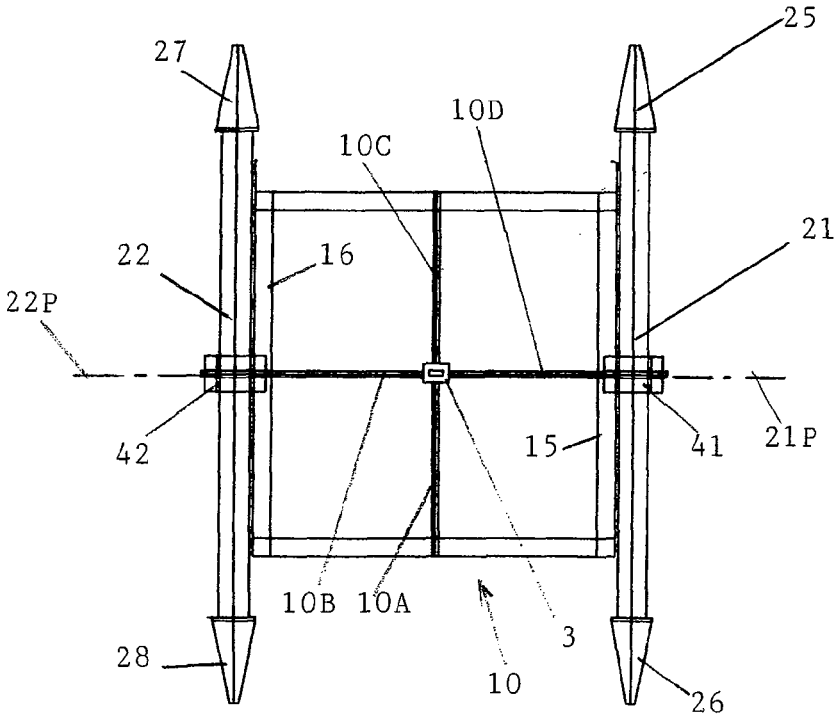
FIG. 3

GUIDE ARRANGEMENT

RELATED APPLICATION

This application claims the benefit of priority from Norwegian Patent Application No. 2008 3370, filed on Aug. 1, 2008, the entirety of which is incorporated by reference.

BACKGROUND

1. Field of Invention

This invention relates to a guide arrangement for marine risers, in particular for offshore oil and gas operations.

2. Description of Related Art

Risers are often used for connecting offshore floating platforms or vessels with subsea installations. Such risers may be of various kinds, for example electric cables, fluid pipes, umbilicals or other forms of combined risers being of a flexible character. Typically, these risers are provided at intermediate portions of their length with buoyancy elements so as to obtain a favourable total curve or trajectory of the risers through the water.

In some cases where dynamic conditions have to be taken into consideration and there is limited space available around the floating platform or vessel concerned, there is a requirement for stabilizing or anchoring the risers so as to reduce or avoid sideways motions thereof. Such motions may be caused by sea currents or waves as well as other influences acting on the risers and/or platform/vessel.

In a known solution (Subsea Arch System by CRP Group Limited, Lancashire, England) to the above problem there is provided

- at least one guide structure for a length of riser,
- a frame assembly for supporting said guide structure,
- anchor means at the seabed,
- tether means connecting said frame assembly to said anchor means, and
- a buoyancy element for keeping said guide structure at a desired level in the sea during operation.

More specifically, the known solution involves the use of a fixed guide structure in the form of an arch having an upward or "convex" curvature when installed for stabilizing one or more risers. However, the combination of a light and flexible riser, such as an umbilical or the like, with large dynamic movements as explained above, will require very large bending stiffeners at the entrance and exit of the arch. This involves highly increased costs.

OBJECTS AND SUMMARY

Substantial improvements in relation to the above are provided according to this invention, by having the guide structure pivotably supported by said frame assembly with a pivot axis being substantially horizontal.

Advantages obtained with this new guide arrangement are primarily a reduction in bending stress and strain imposed on the riser or umbilical, elimination of very large bend stiffeners, lighter steel structure work and easy installation.

BRIEF DESCRIPTION OF THE DRAWINGS

Further explanations of the invention follows below with reference to an embodiment of the invention as illustrated in the drawings, of which:

FIG. 1 is a system overview of a typical riser installation with a "lazy wave" configuration between a surface vessel and the seabed, FIG. 2 in elevation shows more in detail the cooperating parts of the guide arrangement included in FIG. 1, and FIG. 3 shows a plan view according to line II-II in FIG. 2.

DETAILED DESCRIPTION

Figure 2:
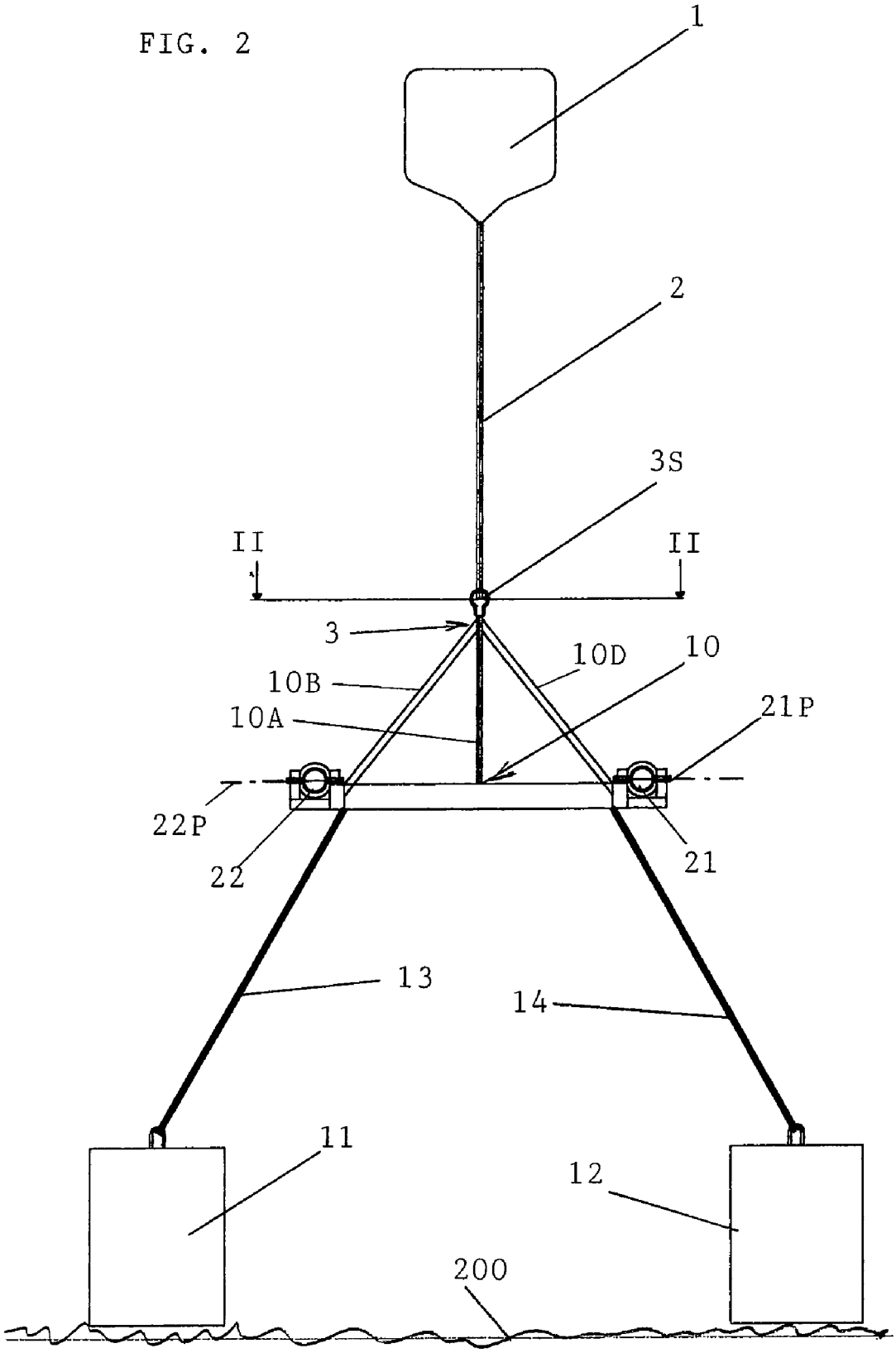

In the typical situation of FIG. 1 a vessel 90 on sea surface 100 is connected through a riser 30 to a subsea installation (not shown). At a middle portion of riser 30 there are provided buoyancy elements 33 so as to obtain a desired configuration of the riser as a whole. Thus, as extended from vessel 90 the riser 30 will have an upward inclination before the buoyancy element portion 33. At this intermediate portion of the riser there may be a need for some stabilization or anchoring of the riser 30, in particular against movements in a lateral direction related to the general plane followed by riser configuration 30.

Thus, a guide arrangement according to the invention providing for such anchoring, is shown in FIG. 1 with bottom anchor blocks 11 and 12 at seabed 200, with tethers 13, 14 connected to a frame assembly 10 supporting a guide structure 21, whereby a buoyancy element 1 serves to keep the guide arrangement at a desired level in the sea. As will be seen better from FIG. 3, the guide structure 21 may freely and pivotably adjust itself to the inclined configuration or portion of riser 30 passing through guide structure 21.

Referring now to FIG. 2 as well as FIG. 3, the embodiment shown therein comprises two guide structures 21 and 22 provided at respective side parts 15 and 16 of frame 10, as shown in particular in FIG. 3. Thus, this embodiment is useful in the case of two more or less parallel risers 30, which is a situation being quite frequent in actual practice.

In this case frame 10 has a rectangular main shape and is adapted to have a substantial horizontal orientation in the sea. For this purpose the frame 10 is suspended by brace members 10A, 10B, 10C and 10D extending at an inclination from respective attachment points at the frame 10 upwards to a common, central suspension point 3 above the horizontal frame 10. Between buoyancy tether 2 and the top of braces 10A-D there is provided a swivel 3S with a vertical axis of rotation. Guide structure 21 is pivotably supported by frame 10 at a pivot axis 21P whereas guide structure 22 in a corresponding manner is pivotably supported about axis 22P. Axis 21P and axis 22P are both substantially horizontal, so as to make possible an inclined position of guide structures 21 and 22, for example as shown in FIG. 1. Such angular movement of the guide structures is individual, allowing for different angles of inclination of the two guides. For such movements it is an advantage that the pivot axes 21P, 22P are located at a middle portion of the length of each guide structure 21, 22, preferably at a midpoint thereof. Accordingly there will be a kind of balanced arrangement of these guide structures.

In order that tethers 13 and 14 shall not prevent the movements of guides 21, 22 they should be attached to frame 10 in a central region along side members 15 and 16, preferably adjacent to axes 21P and 22P, respectively. For increased stability there may also be provided a third (or further) tether(s) with a bottom anchor at a point displaced from the line between anchors 11 an 12.

Another feature of significance is also seen from FIG. 3, namely that the length of each guide structure 21, 22 is so large as to make the ends of these structures project outside the frame 10. These ends of the guides are provided with relatively short bend stiffeners 25-28, respectively. Thus, such bending stiffeners have a length being just a small fraction of the length of the guide structures. On the other hand the length of each guide structure 21, 22 is many times the diameter of the riser 30. This will provide for a secure angular movement as desired, when in operation the guide structures are under the influence of risers running through them.

It is preferred according to the invention to let the guide structures 21 and 22 have a basic pipe shape with an essentially rectilinear configuration. Moreover, for the required fixation of risers 30 through guide structures 21 and 22 against longitudinal displacement, clamps 41 and 42 are provided at a middle portion of each guide structure. Such clamps may be of more or less conventional types and are not shown in detail in the drawing.

Mounting of the guide structures 21, 22 onto a riser 30 can be done at a laying vessel when deploying the riser at the offshore installation site. In the case of pipe-shaped guides (see FIGS. 2 and 3) the riser may be threaded through its guide or the guide may be split longitudinally for placing the riser first in one half pipe whereupon the other half is mounted so as to form a complete, closed guide containing a length of the riser. Then the assembly is deployed into the sea and afterwards each guide is connected to the frame pivot. The arrangement of frame 10, anchors 11, 12, tether 2 and buoyancy element 1 can be installed before or after deployment of the riser 30 with the guides mounted thereto.

It will be understood that many modifications are possible, deviating from the exemplary embodiment shown in FIGS. 1-3. The riser configuration may be different and the present guide arrangement could be located at other portions of the riser configuration than illustrated in FIG. 1. Anchors 11 and 12 could be of any other type of anchor than the gravitation blocks shown, for example pile anchors. There may also be modifications of guide arrangements with only one guide structure, and in such case the frame assembly may be much simpler than illustrated in the drawing.

The invention claimed is:

1. A guide arrangement for marine risers, in particular for offshore oil and gas operations, comprising:

a frame having a plurality of braces inclined upwardly towards a common swivel point;

at least one guide structure pivotably coupled to said frame for pivotably supporting said at least one guide structure with a substantially horizontal pivot axis;

a buoyancy element;

a first tether coupling said common swivel point to said buoyancy element for keeping said at least one guide structure at a desired level in a sea during operation;

anchor means at a seabed; and a second tether means coupling said anchor means to said frame.

2. The arrangement according to claim 1, wherein a length of said at least one guide structure is many times larger than a diameter of a riser.

3. The arrangement according to claim 1, wherein there are provided bending stiffeners at both ends of said at least one guide structure, a length of each bending stiffener being a small fraction of a length of said at least one guide structure.

4. The arrangement according to claim 1, wherein said frame has a substantially rectilinear main shape.

5. The arrangement according to claim 1, wherein said at least one guide structure has a basic pipe shape.

6. The arrangement according to claim 1, wherein a clamp for a riser is provided in said at least one guide structure, preferably located at a middle portion of the guide structure.

7. The arrangement according to claim 1, wherein two of said at least one guide structure are provided each at an opposite side of said frame.

8. The arrangement according to claim 7, wherein a length of said at least one guide structure is larger than a corresponding side length of said frame.

9. The arrangement according to claim 7, wherein said frame is adapted to have a substantially horizontal orientation in operation.

10. The arrangement according to claim 1, wherein there is provided a swivel with a vertical axis of rotation, between said buoyancy element and said frame.

* * * * *